United States Patent [19]

Oppedal

[11] Patent Number: 4,819,863

[45] Date of Patent: Apr. 11, 1989

[54] FLUID-TIGHT SEALED CONTAINER WITH LID

[75] Inventor: Tor Oppedal, Drammen, Norway

[73] Assignee: Elopak A/S, Lier, Norway

[21] Appl. No.: 219,229

[22] PCT Filed: Nov. 28, 1985

[86] PCT No.: PCT/NO85/00074

§ 371 Date: Jul. 24, 1986

§ 102(e) Date: Jul. 24, 1986

[87] PCT Pub. No.: WO86/03174

PCT Pub. Date: Jun. 5, 1986

Related U.S. Application Data

[63] Continuation of Ser. No. 890,851, Jul. 24, 1986, abandoned.

[30] Foreign Application Priority Data

Nov. 28, 1984 [NO] Norway ..... 844733

[51] Int. Cl.[4] ..... B65D 43/02; B65D 43/08

[52] U.S. Cl. ..... 229/125.35; 220/359; 229/5.5

[58] Field of Search ..... 229/4.5, 5.5, 125.33, 229/125.35; 220/359, 356, 366, 265; 215/232

[56] References Cited

U.S. PATENT DOCUMENTS

| | | | |
|---|---|---|---|
| 2,533,159 | 12/1950 | Yates | 220/356 |
| 2,790,576 | 4/1957 | Lawrence | 220/356 |
| 2,802,593 | 8/1957 | Slaughter | 220/359 |
| 3,434,651 | 3/1969 | Stec | 229/5.5 |
| 3,504,817 | 4/1970 | Heider | 215/232 |
| 3,604,613 | 9/1971 | Haas | 229/3.1 |
| 3,654,842 | 4/1972 | Schwenk | 93/94 PS |
| 3,767,076 | 10/1973 | Kennedy | 215/232 |
| 3,817,417 | 6/1974 | Edwards | 215/232 |
| 3,912,154 | 10/1975 | Godar | 229/5.5 |
| 3,933,297 | 1/1976 | Carlsson et al. | 229/43 |
| 4,013,188 | 3/1977 | Ray | 215/232 |
| 4,044,941 | 8/1977 | Knudsen | 215/232 |
| 4,196,841 | 4/1980 | Smith et al. | 229/43 |
| 4,209,126 | 6/1980 | Elias | 220/359 |
| 4,241,864 | 12/1980 | Kessler | 229/43 |
| 4,469,258 | 9/1984 | Wright et al. | 229/43 |
| 4,540,391 | 12/1982 | Fries | 493/287 |
| 4,557,414 | 12/1985 | Ford et al. | 229/43 |

FOREIGN PATENT DOCUMENTS

| | | | |
|---|---|---|---|
| 2631715 | 2/1977 | Fed. Rep. of Germany . | |
| 2851605 | 6/1979 | Fed. Rep. of Germany | 229/5.5 |
| 113912 | 4/1945 | Sweden | 229/43 |
| 887240 | 1/1962 | United Kingdom | 229/5.5 |
| WO85/048-18 | 11/1985 | World Int. Prop. O. . | |

*Primary Examiner*—Stephen P. Garbe
*Assistant Examiner*—Gary E. Elkins
*Attorney, Agent, or Firm*—Cushman, Darby & Cushman

[57] ABSTRACT

A fluid-tight sealed container with a lid is manufactured from cardboard, plastic, plastic coated cardboard or the like. The side walls of the container (1) end with a narrow rim in the opening plane of the container, against which the lid (2) is in sealing contact. At least on the portion of the lid (2) being in contact with the container rim the lid is coated with a flowable polymer coating. The rim of the container opening is melted into the polymer material to a depth that ensures sealing but still permits tearing off the lid (2). In order to permit repeated use of the lid it may be provided with a vertical flange portion (4) that is provided with symmetrically arranged bosses (5) on the side facing the side wall faces of the container (1).

17 Claims, 4 Drawing Sheets

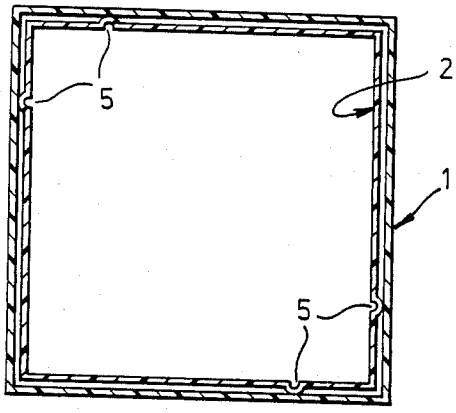
Fig. 5.
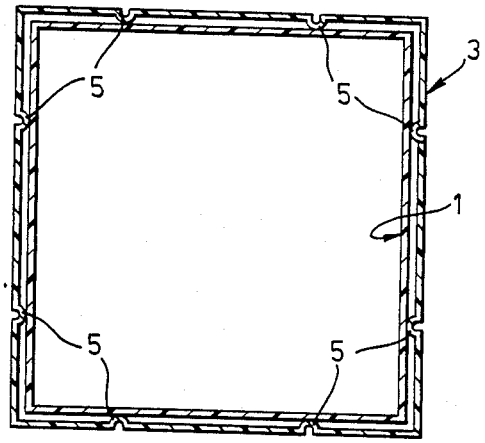
Fig. 6.
Fig. 7.
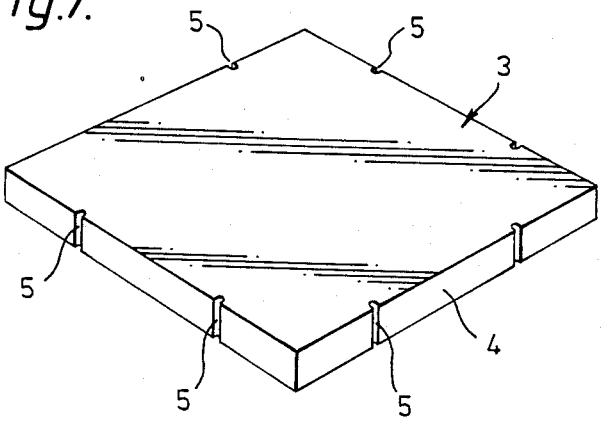

FLUID-TIGHT SEALED CONTAINER WITH LID

This is a continuation of application Ser. No. 890,851, filed July 24, 1986, now abandoned.

The present invention relates to a fluid-tight sealed container with a lid, made from plastic, plastic coated cardboard, or the like, the container side walls in the opening plane being terminated with a narrow rim and said lid being placed sealingly over the container opening. The invention relates to containers and lids of the disposable kind as well as to containers the lids of which are intended for repeated application.

In case of containers intended for foodstuffs, e.g. dairy products, it is essential both in view of the durability of the contents and of transport that the containers are completely closed or sealed, and it is equally important that the containers may be easily opened. Since such products are mass produced it is also essential that container production is possible with maximum simplicity and at minimum cost. This especially applies to disposable containers the entire content of which is used all at once. However, the same demands are made to a large extent on containers the content of which is not used all at once and where it is desirable to put on the lid repeatedly.

It proved difficult in practice to meet all these demands in one container. Either the lid is sealed so well that it is difficult to open the container, or the container was not sufficiently tight before it was opened. In case of inexpensive container/lid combinations the user is sometimes faced with the problem that it is impossible to place the lid on the container in a satisfactory manner after the container had been opened the first time.

It is, thus, an object of the present invention to provide a container with a lid that complies with all above-mentioned requirements.

This object is achieved by a container of the kind mentioned above that is characterized by the features stated in the claims.

In connection with the present invention a special composition of materials in the lid was combined with a deliberate utilization of the "sharp" edge of the container opening. It was, thus, possible by suitably adjusting parameters to achieve a seal that is tight and stable during transport and storage, but which is easily torn up without destruction of the rim portions or the lid, enabling removing of the content in a cleanly and simple manner. Also, a lid intended for repeated use may be replaced although no tight seal is obtained upon replacement.

There are many possible embodiments within the scope of this inventive concept. It is, thus, possible only to coat the contact surface area of the lid with the container edge with a flowable polymer composition that will provide the desirable properties. On the other hand, the entire lid may, if desired, be coated with such a material which may e.g. be laminated onto the lid material during lid production. If desired and suitable the entire container may be produced from such a material or its inner surface may be coated with such a material, respectively. If the lid is produced in a disposable form, production may be maximum simple and inexpensive, said lid being shaped as a plane surface that may be torn from one of the lid end edges. A lid intended for repeated use is provided with a vertical flange for insertion into the container opening or for being pushed over said container opening, respectively. In both cases said flange is provided with guide bosses which will also ensure stability of the container shape. The inventive concept may be utilized regardless of the shape of the container but it will be especially advantageous with quadrangular containers with a lid for repeated use.

In the following the invention will be disclosed in more detail with reference to embodiments shown in the drawings, where FIG. 1 shows a disposable container in perspective.

FIG. 5 is a section showing the arrangement of the vertical lid portion in relation to the container in the above embodiment.

FIG. 6 is a section corresponding to FIG. 5, but showing a third embodiment.

FIG. 7 is an elevational view in perspective of the lid illustrated in FIG. 6, and FIGS. 8 and 9 are elevational views illustrating the two last mentioned embodiments with the lids put on the containers.

Figure 1:
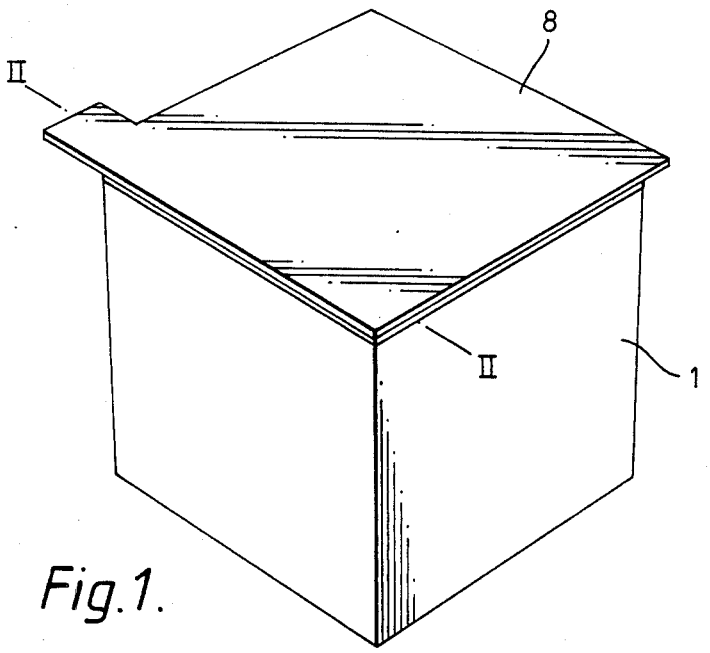

Some embodiments are shown schematically in the drawings. The figures, thus, show containers designated 1 that may be made from cardboard, plastic coated cardboard or a plastic material. In an advantageous structure said containers are also provided with an inside layer of aluminum foil. At the upper rim of the contaier this layer may suitably be extended over the rim and a short distance downward on the outside. Such an aluminum foil coating in the rim area may be advantageous as regards sealing, as disclosed in the following. An aluminum foil coating of this kind is illustrated in FIG. 2, designated 7.

Containers of the kind illustrated in the figures are suitably manufactured from cardboard, plastic coated cardboard, or a plastic material as mentioned above. Polyethylene is an example of a suitable material. Container 1 which is open upwards is meant to be closed and sealed during storage and transport with a lid designated 8, 2, and 3 respectively in the shown embodiments. Said lid may be constructed on the basis of a cardboard or plastic material, e.g. polyethylene, and may have a thickness of e.g. 300 μm. In any case, said lid is coated with a flowable polymer material. The build up may e.g. be carried out by lamination or coextrusion. Taking the kind of material in the container and, thus, the nature of the container rim into consideration a choice must be made as regards the thickness and nature of the flowable polymer mass to ensure a lasting seal around the entire rim. The flowable polymer material may be a polyethylene showing suitble flowability, or e.g. an ionomer resin among which "surlyn" may be mentioned. A preferred thickness of the inside lid layer is approximately 100 μm. However, the thickness of this layer will depend on the rim quality of the container 1, an essential feature being that said inner layer is able to absorb unevenness in the rim area. The depth of penetration into the container rim may be between 10 and 90 μm. It is also possible to use combinations of e.g. polyethylene and ionomer resin in the flowable layer. In this case a thickness of 80 μm may e.g. be used for the polyethylene layer, and a thickness of 20 μm may be used for the contactl ayer of ionomer resin.

The lid is sealed to the container by heat/pressure or by welding in the narrow area forming a contact surface between the upper end rim of the container and the lid. For this object, e.g. a high frequency welding coil mounted in a welding head may be used. Said welding coil may have a shape corresponding to that of the container rim and will induce a heating zone causing the container rim and the inside layer of the lid to melt together. The depth of penetration of the rim into said layer is also adjustable by pressure. There is also the possibility of using equipment yielding a variable welding pressure, which will make it easier to tear off the lid whenthe container is to be opened, such varying welding pressure resulting in an effect of the same kind as that achieved with perforation, although there are no holes.

Figure 2:
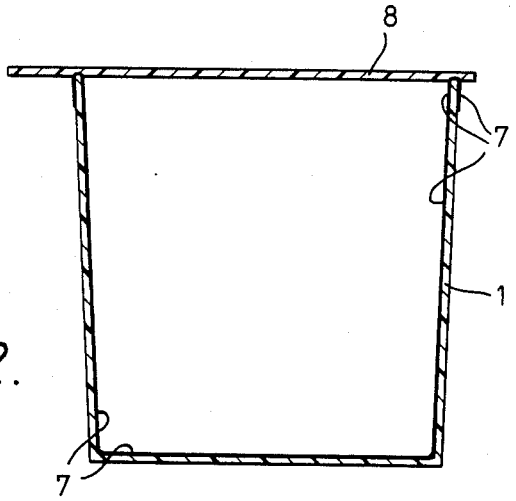
FIG. 2 is a section along line II—II in FIG. 1 of the container according to FIG. 1.

FIGS. 1 and 2 show a first embodiment. The container generally shown is intended to be disposable, i.e. its content is used all at once and there is not need for a lid that may be replaced on the container rim. In this case said lid may have the most simple shape possible, e.g. the shape of a totally plane surface that may e.g. be somewhat larger than the circumference of the container. Such a lid is designated 8. Said lid may have a tear off flap in one corner as indicated in FIG. 1. By the aid of a welding head with a welding coil as disclosed above said lid 8 is pressed down onto the container opening. The sharp rim of the container will then melt into the inside coating of the lid and by melting together with said coating will form a fluid-tight seal. When such a welding coil is used it is most advantageous to use an aluminum foil 7 that is extended over the rim of the container forming a so-called skived edge. Said aluminum foil will induce heating with use of said welding coil resulting in simplified and easier melting or welding. In containers for e.g. juice or the like said aluminum foil 7 may coat the entire inside of the container. It is also conceivable to use only a strip in the rim area.

In FIGS. 1 and 2 a lid is illustrated which only extends a small distance outside the circumference of the container. In order to render tearing up easier it will be suitable to provide a tear up flap, preferably in a corner area. Another approach is to elongate said lid outside the container rim on all sides enabling the lid to be torn off from any point of attack. Another approach is e.g. in such a case to notch the projecting edge in the corner areas and bend it down in order to achieve a more neat shape of the lid. All three variants mentioned will form very inexpensive lid embodiments. It is, however, observed that other lid shapes are also possible.

In the following embodiments shown in the drawing an essential feature of the lid shape is a vertical portion or flange 4 and the provision of a number of bosses 5 in said flange portion. On this basis the lid may have different shapes, two of which are illustrated in FIGS. 3 to 9.

Figure 3:
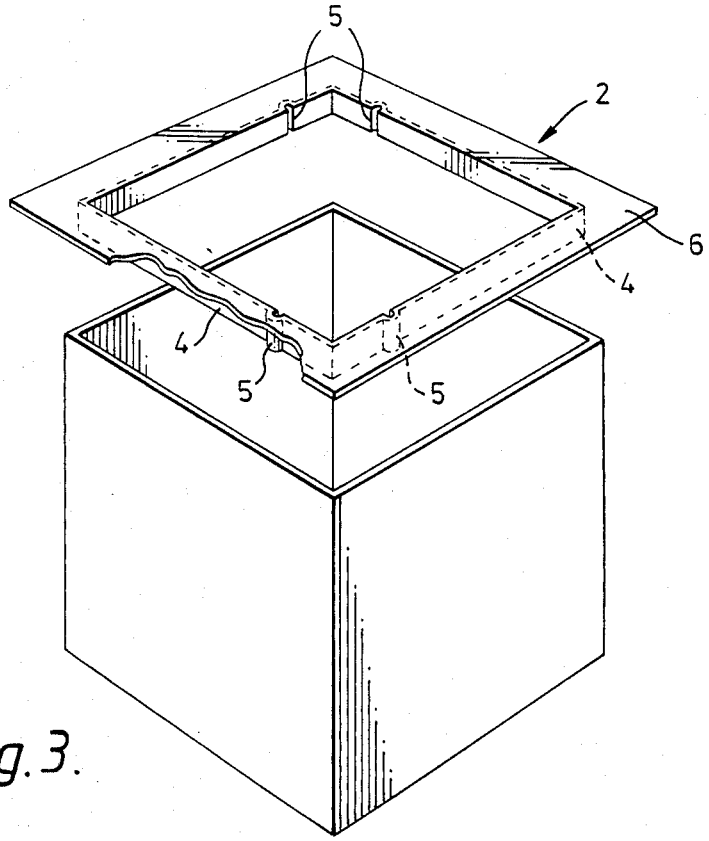
FIG. 3 shows a container, e.g. for yoghurt, with a lid that is intended for repeated use according to another embodiment of the invention, said lid being shown in a somewhat lifted position in perspective.
Figure 4:
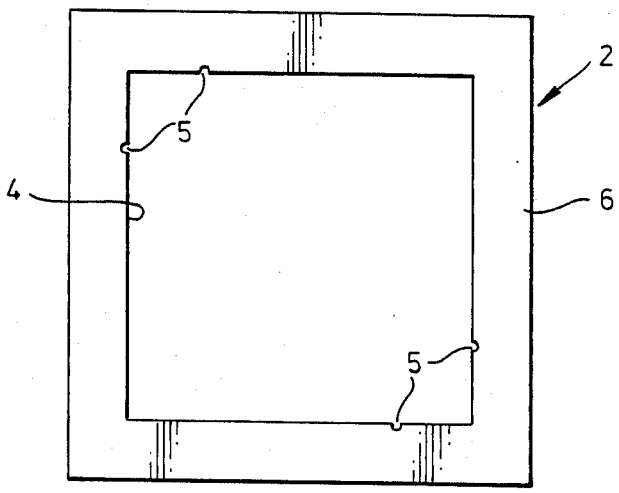
FIG. 4 is an elevation of the lid according to FIG. 3, as seen directly from above.

In FIGS. 3 to 5 the disclosed lid is provided with an internal recessed portion intended for insertion into the container opening for closing and sealing said opening. The vertical flanges 4 of the lid are arranged corresponding to the shape of the container opening, a square shape in the shown embodiment. In an outward direction from the vertical flange portion a set of projecting bosses or lug-like projections are provided. In FIG. 3 four such bosses are shown symmetrically arranged at two opposite corners of the lid and symmetrical with a diagonal of the lid. Such a positioning will make it easier to tear up the seal of the lid when the container is opened the first time. Said bosses, however, may be placed at other locations, e.g. in the middle of the sides, or a larger number of bosses may be used. In this connection it is essential that the external periphery of the bosses corresponds to the internal width of the container and when inserted will stabilize the square shape of the container as well as forming a guide in connection with insertion and a holding support when the lid is put on the container.

As mentioned above, sealing is achieved by heat/pressure or by welding in the narrow area that forms a contact surface with the upper rim of the container. E.g. a high frequency welding coil having a shape that corresponds to the container rim may be used, and said welding coil will induce a heating area which will cause the container rim and the inside layer of the lid to melt together. The depth of penetration of the rim into said layer is also adjustable by the influence of pressure. It is essential that the depth of penetration is larger than any unevenness of the lid edge in order to ensure a tight seal. If desired, the bosses of the lid and the side walls of the container may be melted together as well, resulting in additional spot connection. Said bosses may have a length of 1.5 to 2 mm. The lid is put on the container in a conventional manner. Also, it is observed that it will be advantageous, as mentioned above, that an aluminum foil coating is used in the rim area (skived rim) when a welding coil is used, although this is only considered the preferred embodiment, and welding may also be achieved solely by the influence of heat/pressure.

In order to simplify handling of the lid it is preferably provided with an edge flange 6 projecting beyond the periphery of the container. Said flange may preferably be provided with a tear instruction or a tear off flap in the corners which are not provided with bosses. Alternatively, said external flange may have the same size as the container and be provided with one tear off flap in a corner.

As illustrated in FIG. 5, a very narrow space will remain between the container wall and the vertical flange portion of the lid because of the bosses. This causes the contact/sealing surface to be maintained at a minimum that is clearly defined by the container rim and will be equal for all containers of the same kind.

In FIGS. 6 and 7 another embodiment of the lid is shown which, however, operates according to the same principle. The difference is that the vertical flange portion of the lid is intended to be placed outside the container walls instead of being inserted into the container opening.

The surface of contact between the flowable polymer layer of the lid and the container rim will be of the same kind as in the emboidment discussed above, and the bosses will have a stabilizing guiding and holding effect on the lid in this case as well. Also, there will be provided a small distance between the vertical flange of the lid and the container wall in order to avoid welding together in this area. In order to simplify the opening procedure it may be suitable to provide a tear off flap at one corner or a side edge. FIG. 6 shows an embodiment provided with a double set of bosses, resulting in bosses arranged at all four corners.

Figure 8:
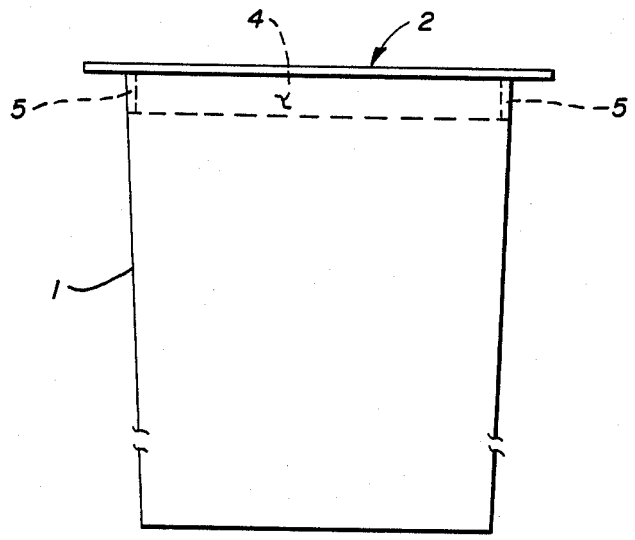
Figure 9:
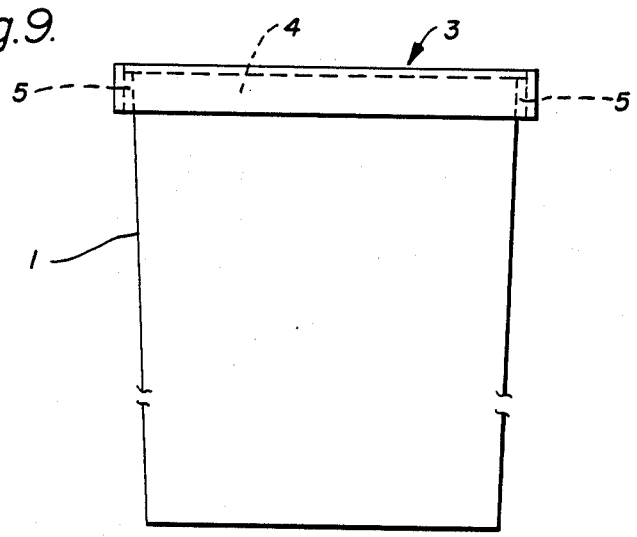

FIGS. 8 and 9 show how the lids of the two embodiments are placed in relation to the container per se and how the bosses form bridging elements.

It will be obvious that the present invention is not limited to square or quadrangular containers and lids for said containers, the basic concept of the invention being applicable to any suitable container shape and lid shape. The invention may, thus, e.g. be used for cylindrical containers if this is deemed desirable. Numerous modifications are, thus, possible within the scope of the invention. This, also, goes for the choice of a flowable polymer material and parameters of melting together, the essential fact being that a fluid-tight melting is achieved that may be torn up by normal display of force.

I claim:

1. A fluid-tight sealed container comprising:

a container body having a bottom, an open top and side walls defining a narrow rim about said open top, the width of said rim being substantially equal to the thickness of said side walls; and a lid engaging said rim, sealingly closing said open top and detachably secured to said body;

said lid, at least in the area thereof engaging said rim, having a weldable coating of a flowable polymer having a thickness of about 100 μm, said rim being coated with aluminum foil, and said lid being welded to said rim by having been melted by heat into said polymer coating and penetration thereinto to a depth of from about 10 μm to about 90 μm whereby because of the relative dimension of said rim a mechanical interlock is formed between said rim and said lid and sealing and securement of said lid to said body is ensured but said lid can be easily torn off of said body.

2. The container defined in claim 1 wherein the polymer coating and the lid are polyethylene.

3. The container defined in claim 1 wherein the polymer coating is an ionomer resin.

4. The container defined in claim 1 wherein the polymer coating is a two-layer coating, preferably consisting of 80 μm polyethylene and 20 μm ionomer resin.

5. The container defined in claim 1 wherein the entire inside of the lid is coated with the polymer coating.

6. The container defined in claim 1 wherein the lid is substantially planar and projects outside the rim.

7. The container defined in claim 6 wherein that portion of the lid projecting outside the rim is of the order of about 1 mm and includes a tear off flap of greater width.

8. The container defined in claim 1 wherein the rim is defined by straight portions with adjacent portions converging and the lid has flanges corresponding to said portions and depending outside the side walls.

9. The container defined in claim 1 wherein the body and lid are made of one of cardboard, plastic coated cardboard and plastic.

10. A lid especially intended for repeated detachment from and resecurement to and for closing and sealing a container body having a bottom, an open top and side walls defining a narrow symmetrical rim about the open top, said lid having an area adapted to engage the entire surface of the rim, at least said area being coated with a weldable coating of a flowable polymer having a thickness of about 100 μm so that said area can be engaged with the rim and welded thereto by melting said coating to achieve penetration of the rim thereinto to a depth of from about 10 μm to about 90 μm, whereby sealing and securement of said lid to the body is ensured but said lid can be easily torn off of the body; said lid including a depending flange portion for cooperation with the side walls of the body, said flange portion having symmetrically arranged bosses adapted to face the side walls.

11. A lid as defined in claim 10 for a container body having a quadrangular rim defining opposed corners and the bosses are arranged to be positioned adjacent such corners symmetrically about a line joining opposed such corners.

12. A lid as defined in claim 11 wherein ther eare bosses adapted to be arranged adjacent all such corners.

13. A lid as defined in claim 10 wherein the flange portion is adapted to face the inner side of the side walls of the container.

14. A lid as defined in claim 13 wherein the area is between the flange portion and periphery of the lid.

15. A lid as defined in claim 10 wherein the flange portion is adapted to face the outside of the side walls of the body.

16. A lid as defined in claim 15 wherein the flange portion is between the area and the periphery of the lid.

17. A lid as defined in claim 10 wherein the bosses have areas adapted to contact the side walls and said boss areas also are coated with the polymer to be melted along with that on the area to be engaged with the rim.

* * * * *